US005478164A

United States Patent [19]

Mori

[11] Patent Number: 5,478,164

[45] Date of Patent: Dec. 26, 1995

[54] METHOD OF DRIVING DC MOTOR IN PRINTER

[75] Inventor: Masahiko Mori, Tamayama, Japan

[73] Assignee: Alps Electric Co., Ltd., Tokyo, Japan

[21] Appl. No.: 178,589

[22] Filed: Jan. 7, 1994

Related U.S. Application Data

[63] Continuation of Ser. No. 957,310, Oct. 5, 1992.

[30] Foreign Application Priority Data

Oct. 16, 1991 [JP] Japan ..... 3-267494

[51] Int. Cl.[6] ..... B41J 19/00

[52] U.S. Cl. ..... 400/74; 400/322; 400/903; 318/434

[58] Field of Search ..... 400/279, 320, 400/322, 70, 903, 74, 54; 318/434

[56] References Cited

U.S. PATENT DOCUMENTS

| | | | |
|---|---|---|---|
| 4,354,214 | 10/1982 | Walton | 361/23 |
| 4,467,250 | 8/1984 | Thomasson | 318/40 |
| 4,609,954 | 9/1986 | Bolton et al. | 360/78 |
| 4,725,765 | 2/1988 | Miller | 361/31 |
| 4,801,223 | 1/1989 | Goto | 400/145.1 |
| 4,871,272 | 10/1989 | Stein | 400/63 |
| 4,884,162 | 11/1989 | Ito | 361/23 |
| 5,058,031 | 10/1991 | Swanson | 361/23 |
| 5,113,489 | 5/1992 | Cihiwsky | 361/23 |

FOREIGN PATENT DOCUMENTS

| | | | |
|---|---|---|---|
| 311198 | 12/1990 | Japan | 361/23 |

*Primary Examiner*—Edgar S. Burr
*Assistant Examiner*—Steven S. Kelley
*Attorney, Agent, or Firm*—Guy W. Shoup; Patrick T. Bever

[57] ABSTRACT

When a DC motor is restarted, a drive signal for the DC motor serves as a pulse signal. Even when a printer is stopped under a maximum load, the DC motor may be restarted a plurality of times, thus vibrating the DC motor and reducing the degree to which the printer is locked. This makes it possible to easily restart the DC motor.

5 Claims, 1 Drawing Sheet

METHOD OF DRIVING DC MOTOR IN PRINTER

This application is a continuation of application Ser. No. 07/957,310, filed Oct. 5, 1992.

BACKGROUND OF THE INVENTION (1) Field of the Invention

The present invention relates to a method of driving a DC motor in a printer operating a drive member by using the DC motor and, more particularly, to an improvement in the method of starting the DC motor.

(2) Description of the Related Art

FIG. 2 shows an example of a standard printer performing a printing operation using a type face belt. A worm 4 is fixed to an output shaft 3 of a DC motor 2 fixed to a frame 1. There are two idle gears 5 and 6 engaging with each other. One idle gear 5 is engaged with the worm 4, whereas the other idle gear 6 is engaged with a planetary gear mechanism (not shown) disposed at the left end of the frame 1. A main gear 7 and a drive pulley 8 rotatable together with a ratchet (not shown) are coaxially attached to the planetary gear mechanism. Cam recesses 9 are formed at the outer periphery of the main gear 7 so as to diametrically face each other.

A clutch gear 11 of an electromagnetic clutch 10 is engaged with the idle gear 6. A yoke 12 is coaxially attached to the electromagnetic clutch 10 and rotated by the rotation of the clutch gear 11. An electromagnetic plate 13 is disposed under the yoke 12 and drawn toward the yoke 12 when electricity is supplied to an electromagnetic coil (not shown) inside the yoke 12. A mating hole is formed in the electromagnetic plate 13.

A selection lever 15 branching out into three directions is rotatably attached to the shaft of the idle gear 6. A mating pawl **16*a* or 16*b* (only the pawl 16*b* being shown in FIG. 2) is formed at the end of either of the two portions of the selection lever 15 so that these pawls 16*a* and 16*b* are selectively engaged with the cam recess 9 in the main gear 7 and the tooth of the ratchet. A projection 17 is formed at the end of the one remaining portion of the selection lever 15 so that it is inserted into the mating hole 14 in the electromagnetic plate 13**.

A lever spring 18 is attached to the selection lever 15, and used for urging the lever 15 counterclockwise as viewed in FIG. 2. One end of the lever spring 18 is fixed to the frame 1. The force exerted on the lever spring 18 maintains the selection lever 15 such that one engaging pawl **16*b* is engaged with the cam recess 9 in the main gear 7 and the other engaging pawl 16*a* is disengaged from the tooth of the ratchet when the lever 15** is at its home position.

The drive pulley 8 faces one side of the frame 1, whereas a driven pulley 19 faces the other side of the frame 1. A type face belt 21 is wound around the drive and driven pulleys 8 and 19, respectively, and serves as a type face supporting member in which a large number of type faces 20 are projected at certain intervals from the outer peripheries of the drive and driven pulleys 8 and 19, respectively.

A bevel gear-shaped digit-carrying gear 23 is engaged with the main gear 7 and attached to one end of a drive shaft 22 extending along the length of the frame 1. A hammer holder 24 for accommodating and retaining a hammer (not shown) is disposed inside the type face belt 21 so that it can be slid along the axis of the frame 1. The rotation of the drive shaft 22 operates the hammer.

A plate-like platen 25 supported by the frame 1 is disposed in front of the type face belt 21. A pair of mask members 26 are arranged between the type face belt 21 and the platen 25 so that there is a space substantially equal to the size of one type face 20 between the mask members 26. The mask members 26 are used for preventing the printing of the adjacent undesired type faces when the hammer presses the desired type face on the belt 21 against the platen 25.

A spring member 27 returns the hammer holder 24 to the home position when it is not operated.

A paper feed roller 28 is positioned under the type face belt 21 and the hammer holder 24 and rotatably supported by the frame 1. A pressure roller 29 is disposed over the paper feed roller 28 and used for retaining paper between the paper feed roller 28 and the pressure roller 29.

An ink roll 30 for applying ink to the type faces 20 on the type face belt 21 is disposed near the driven pulley 19.

To select a desired type face 20 in the thus-constructed printer, the DC motor 2 is rotatively driven by a DC signal, thereby rotating the worm 4 and the drive pulley 8 with the aid of the idle gears 5 and 6. This operation drives the type face belt 21 so that the desired type face 20 is moved to the corresponding digit.

When the desired type face 20 reaches the corresponding digit, electricity is supplied to the electromagnetic coil of the electromagnetic clutch 10, thereby suctioning the electromagnetic plate 13 toward the yoke 12. This operation rotates the yoke 12 and the selection lever 15 against the force acting on the lever spring 18. The engaging pawl **16*a* of the selection lever 15 engages with the ratchet, thus stopping the ratchet and then the type face belt 21. Simultaneously, the engaging pawl 16*b* of the selection lever 15 is disengaged from the cam recess 9 in the main gear, thus starting the rotation of the main gear 7**. Under this condition, the supply of electricity to the electromagnetic coil is stopped.

The digit-carrying gear 23 is rotated as the main gear is rotated, thereby operating the hammer so that the desired type face 20 is pressed against the paper. The ink is transferred from the ink roll 30 to the paper, thus printing the desired type face 20.

When the main gear is further rotated after the desired type face has been printed, the engaging pawl **16*b* is moved to the cam recess 9 in the main gear 7. The selection lever 15 is rotated by the force exerted on the lever spring 18. This causes not only the engaging pawl 16*b* of the selection lever 15 to engage with the cam recess 9 in the main gear 7, but also the engaging pawl 16*a*** to be disengaged from the tooth of the ratchet.

The above-described operation is repeated to select the next desired type face, to print it and to carry the digit. This operation is repeatedly performed as many times as the number of digits so that the printing of one line is completed. Upon the completion of the printing of one line, the spring member 27 returns the hammer holder 24 to its home position. The paper feed roll 28 and the pressure roll 29 move the paper in an amount equal to one line so that the next line can be printed.

During the printing operation, when the printer is stopped under a maximum load due to a power failure or a voltage drop in the battery, it requires a large amount of torque to restart the DC motor 2. The reason for this is that molded components stick together when they are compressed.

In order for the DC motor 2 to be restarted with such a maximum load, the following countermeasures are conventionally taken. First, the reduction ratio is increased and the rotation speed of the DC motor 2 is accordingly increased; second, the DC motor 2 is made larger; third, a DC motor having a high torque is employed; and fourth, an entrance period for the DC motor 2 is provided which period serves as a preliminary step for the printing operation.

When the above-mentioned countermeasures are taken, the various problems may occur as follows:

When the first countermeasure is taken, the amount of electric current as well as noise are increased.

When the second countermeasure is taken, it is difficult to further downsize a type face micro printer which is already miniaturized.

When the third countermeasure is taken, an expensive motor must inevitably be employed.

When the fourth countermeasure is taken, the number of components is increased and the reliability of the printer is decreased.

SUMMARY OF THE INVENTION

An object of the present invention is to solve the above problems.

Another object of this invention is to provide a method of driving a small, inexpensive and low-torque DC motor in a printer which is capable of performing a printing operation with low noise without increasing the amount of electric current.

A further object is to provide a method of driving a DC motor in a printer operating at least a part of a drive member by using the DC motor, in which method a drive signal for the DC motor serves as a pulse signal when the DC motor is started.

Yet another object is to provide a method of driving a DC motor in which a drive signal for the DC motor serves as a pulse signal when the DC motor is restarted after lock errors of a printer have been detected.

According to the DC motor driving method of this invention, when the DC motor is started, the drive signal serves as the pulse signal. Because of such a feature, even when the printer is stopped under a maximum load, the DC motor may be started a plurality of times. This vibrates the DC motor and reduces the degree to which the printer is locked. The DC motor can thus be easily restarted.

The drive signal for the DC motor is pulsed only when the DC motor is restarted after lock errors have been detected. The DC motor may also be started by the standard method of supplying electricity if lock errors have not been detected.

DETAILED DESCRIPTION OF THE PREFERRED EMBODIMENT

Figure 2:
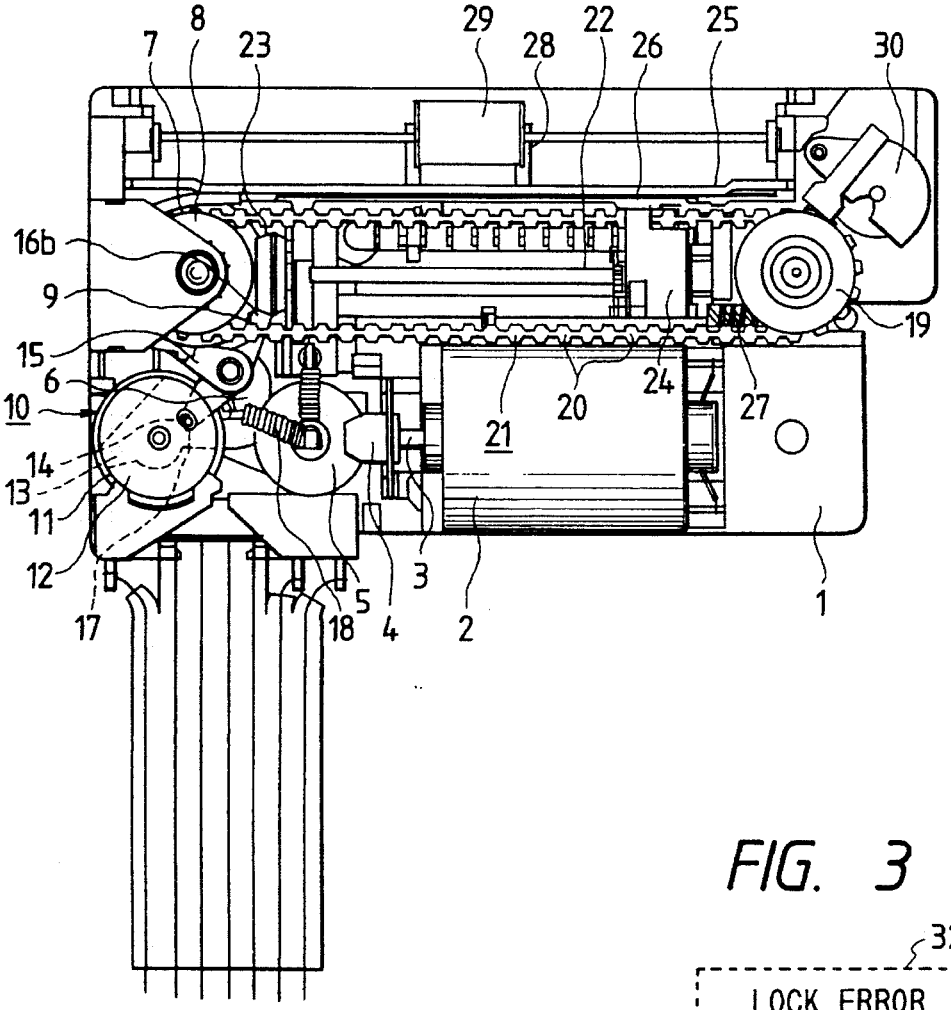
FIG. 2 is a plan view of a standard type face printer.

The present invention will be described below with reference to the accompanying drawings. Since the printer of this invention has a structure the same as that of the printer shown in FIG. 2, only the method of driving a DC motor 2 shown in FIG. 2 will be described in this embodiment.

Figure 1:
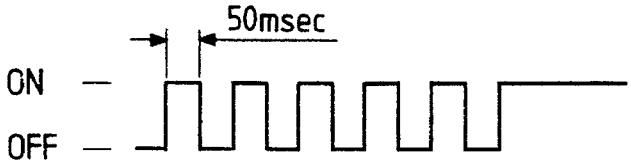
FIG. 1 is a view showing a motor-driving signal used in an embodiment of a method of driving a DC motor in accordance with the present invention.
Figure 3:
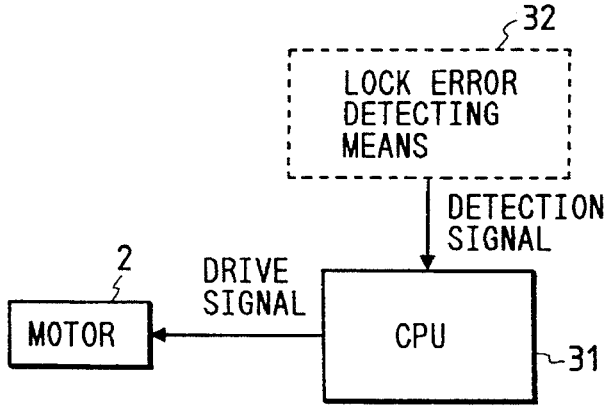
FIG. 3 is a block diagram showing an example of a drive circuit used for carrying out the DC motor-driving method.

FIG. 1 is a view showing a drive signal for the DC motor 2 when the motor 2 is started in accordance with this embodiment, and FIG. 3 is a block diagram of an example of a drive circuit.

Electricity is supplied or not supplied to the DC motor 2 in response to the drive signal output from a CPU 31, thereby operating the DC motor 2. In other words, when the drive signal is continuously fed, the DC motor 2 is continuously driven, whereas when the drive signal serves as a pulse signal having intermittent widths, the DC motor 2 is intermittently driven. A lock error detecting means 32 described later may be attached to the drive circuit.

In this embodiment, as shown in FIG. 1, when the DC motor is started, the pulse signal serves as the drive signal so as to rotatively drive the DC motor 2. The pulse signal has 5 cycles, the duration of a drive portion of each cycle being 50-msec.

The DC motor 2 is intermittently driven 5 times and then vibrated.

Thus even when the printer is stopped under a maximum load, the vibration of the DC motor 2 reduces the degree to which the printer is locked. This makes it possible to easily start the DC motor.

The DC motor 2 is driven intermittently, and then continuously, followed by the printing operation.

If the drive portion of the pulse signal applied to the DC motor 2 is too short, then the DC motor 2 will not effectively transmit force to all of the molded components (members) associated with the drive train such that the vibrations, caused by alternately turning on and turning off the DC motor 2, will separate the stuck-together molded components of the drive train. Conversely, if the drive portion of the pulse signal is too long, the coil of the DC motor 2 will overheat, thus damaging the DC motor 2.

When the DC motor 2 is restarted, the pulse signal serves as the drive signal so as to operate the DC motor 2 a plurality of times, thereby causing the DC motor 2 to vibrate. Even when the printer is stopped under a maximum load, the vibration of the DC motor 2 reduces the degree to which the printer is locked. Thus the above-described embodiment makes it possible to easily restart the DC motor 2.

It is possible to employ a small DC motor having a low torque instead of any other type of DC motor, and to restart the DC motor 2 when the printer is stopped under a maximum load. As a result, the printing operation can be performed with low noise without increasing electric current.

This invention is not limited to the above embodiment, and various modifications can be made as required. For example, the pulse signal serves as the drive signal so as to drive the DC motor 2 a plurality of times only when the DC motor 2 is started after the lock error detecting means 32, indicated by the broken line in FIG. 3, has detected a lock error of the printer.

As has been described, according to the method of this invention of driving a small DC motor having a low torque, the printing operation can be performed with low noise without increasing the amount of electric current.

What is claimed is:

1. A method for driving a DC motor in a printer, the printer including a drive train connected to the DC motor for driving a printing mechanism, the method comprising the steps of:

generating a lock error signal in response to a locked condition of the drive train;

driving the DC motor for a predetermined period using a square wave driving signal such that the DC motor is turned on and off a plurality of times, the square wave drive signal having a period sufficient to transmit force from the DC motor to the drive train; and at the end of the predetermined period, driving the DC motor using a continuous DC drive signal;

wherein the step of driving the DC motor using the square wave drive signal is executed in response to the lock error signal.

2. A method of driving a DC motor according to claim 1 wherein the period of the square wave drive signal is 100 milliseconds.

3. A method for driving a DC motor in a printer, the printer including a drive train connected to the DC motor for driving a printing mechanism, the method comprising the steps of:

generating a lock error signal in response to a detected locked condition of the drive train;

in response to the lock error signal, driving the DC motor for a predetermined period using a square wave driving signal such that the DC motor is turned on and off a plurality of times, the square wave drive signal having a period sufficient to transmit force from the DC motor to the drive train; and at the end of the predetermined period, driving the DC motor using a continuous DC drive signal.

4. A method of driving a DC motor according to claim 3 wherein the period of the square wave drive signal is 100 milliseconds.

5. A method for driving a DC motor in a printer, the printer including a drive train connected to the DC motor for driving a printing mechanism, the method comprising the steps of:

detecting a locked condition of the drive train, the locked condition occurring when a driving force, generated by the DC motor in response to a constant drive signal, fails to drive the printing mechanism;

generating a lock error signal in response to the detected locked condition of the drive train;

in response to the lock error signal, driving the DC motor using a pulsating drive signal such that the DC motor is turned on and off a predetermined number of times, the pulsating drive signal having sufficient electrical energy to cause the driving force from the DC motor to create a mechanical pulse along the entire drive train; and at the end of the predetermined number of times, driving the DC motor using a constant drive signal.

* * * * *